US007517238B2

(12) United States Patent
Ting

(10) Patent No.: US 7,517,238 B2
(45) Date of Patent: Apr. 14, 2009

(54) ELECTRICAL CARD CONNECTOR

(75) Inventor: Chien-Jen Ting, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/012,930

(22) Filed: Feb. 5, 2008

(65) Prior Publication Data

US 2008/0188105 A1 Aug. 7, 2008

(30) Foreign Application Priority Data

Feb. 5, 2007 (TW) ..... 96104014 A
Feb. 5, 2007 (TW) ..... 96202161 U

(51) Int. Cl.
*H01R 13/62* (2006.01)

(52) U.S. Cl. ..... 439/159; 439/607; 439/631

(58) Field of Classification Search ..... 439/159, 439/607, 629, 630, 631
See application file for complete search history.

(56) References Cited

U.S. PATENT DOCUMENTS 7,267,565 B2 9/2007 Hsu et al.
7,309,245 B2 12/2007 Sadatoku
2005/0009389 A1 * 1/2005 Chang ..... 439/159
2006/0089032 A1 * 4/2006 Chen ..... 439/159
2006/0089033 A1 * 4/2006 Chen ..... 439/159
2006/0270260 A1 * 11/2006 Chen et al. ..... 439/159
2007/0032108 A1 * 2/2007 Hsu ..... 439/159

* cited by examiner

*Primary Examiner*—Hien Vu
(74) *Attorney, Agent, or Firm*—Wei Te Chung

(57) ABSTRACT

An electrical card connector (100) includes an insulating housing (2), a plurality of terminals (31) received in the insulating housing, a metal shield (1) associated with the insulating housing to define a card receiving room and an ejector (4) including a slider pin (41). A heart-shaped channel (2012) is recessed on the insulating housing and forms a pair of front-to-back extending channels and a pair of inclined channels, which respectively connect with the front-to-back extending channels and communicate with each other. The slider pin is movably received in the heart-shaped channel. The metal shield forms a resilient piece (18) pressing against the slider pin just at the time of the slider pin located at the jointing point of the inclined channels of the heart-shaped channel.

10 Claims, 8 Drawing Sheets

ELECTRICAL CARD CONNECTOR

BACKGROUND OF THE INVENTION

1. Field of the Invention

The present invention relates generally to an electrical card connector, and particularly to an electrical card connector with an ejector.

2. Description of Related Arts

An electrical card connector has been widely used for achieving data transmission between an electrical card and a corresponding electronic appliance (e.g., cellular phones, personal computers, PDAs, digital cameras and digital audio-visual apparatuses), according to a very fast development of an electronic field. In order to draw the electrical card out of the card connector conveniently, the electrical card connector usually has an ejector to eject the electrical card. An electrical card connector, shown as U.S. Pat. No. 7,267,565, includes a conventional ejector having a slider, a pin member, a resilient element and an ejecting member for contacting and ejecting an electrical card directly. The slider defines a heart-shaped slot recessed downwardly from a top face thereof. A front end of the pin member is moveably disposed in the heart-shaped slot of the slider and a rear end of the pin member is securely locked in a pinhole formed on a rear wall of an insulating housing. Furthermore, a base portion of a shell is formed with a resilient piece, extending downwardly and forward, for pressing downwardly against the pin member in the heart-shaped slot of the slider of the ejector all the time.

Another prior art has been shown as U.S. Pat. No. 7,309,245, which discloses an electrical card connector having an ejector similar to that of U.S. Pat. No. 7,267,565, but a rear end of the pin member is moveably disposed in the heart-shaped slot of the slider of the ejector and a front end of the pin member is fitted into a circular groove of a front wall of an insulating housing to be pivoted thereat. A resilient piece is formed as a cantilever extending portion by bending a part of a cover to extend obliquely downwardly and rearward so as to press against the pin member downwardly and prevent the rear end of the pin member from rising up to disengage away from the heart-shaped slot of the slider.

As we know, the shorter the resilient piece is, the bigger pressure the resilient piece works on the pin member and the more efficiently the pin member moves in the heart-shaped slot. So, if we shorten the length of the resilient piece, we can achieve a better result of pushing and pulling the card. Though the two resilient pieces in the two prior arts said above extend towards two different directions (the former extending downwardly and forward, the latter extending downwardly and rearward), both the ends of the pin members which move in the heart-shaped slots, are far from a point of the shells where the resilient pieces extend from, so, the resilient pieces are usually of large length to press against the far away ends. For large length of the resilient pieces, there may be small stress that the resilient pieces can't effectively keep the movable ends of the two pin members in the hear-shaped slots and we can't efficiently push and pull the electrical card.

Hence, an electrical card connector having a shorter resilient piece is desired.

SUMMARY OF THE INVENTION

Accordingly, an object of the present invention is to provide an electrical card connector including an ejector, a pin member of which is effectively prevented from disengaging away from heart-shaped slot.

To achieve the above object, an electrical card connector includes an insulating housing, a plurality of terminals received in the insulating housing, a metal shield associated with the insulating housing to define a card receiving room and an ejector including a slider pin. A heart-shaped channel is recessed on the insulating housing and forms a pair of front-to-back extending channels and a pair of inclined channels, which respectively connect with the front-to-back extending channels and communicate with each other. The slider pin is movably received in the heart-shaped channel. The metal shield forms a resilient piece pressing against the slider pin just at the time of the slider pin located at the jointing point of the inclined channels of the heart-shaped channel.

Other objects, advantages and novel features of the invention will become more apparent from the following detailed description when taken in conjunction with the accompanying drawings.

DETAILED DESCRIPTION OF THE PREFERRED EMBODIMENT

Figure 1:
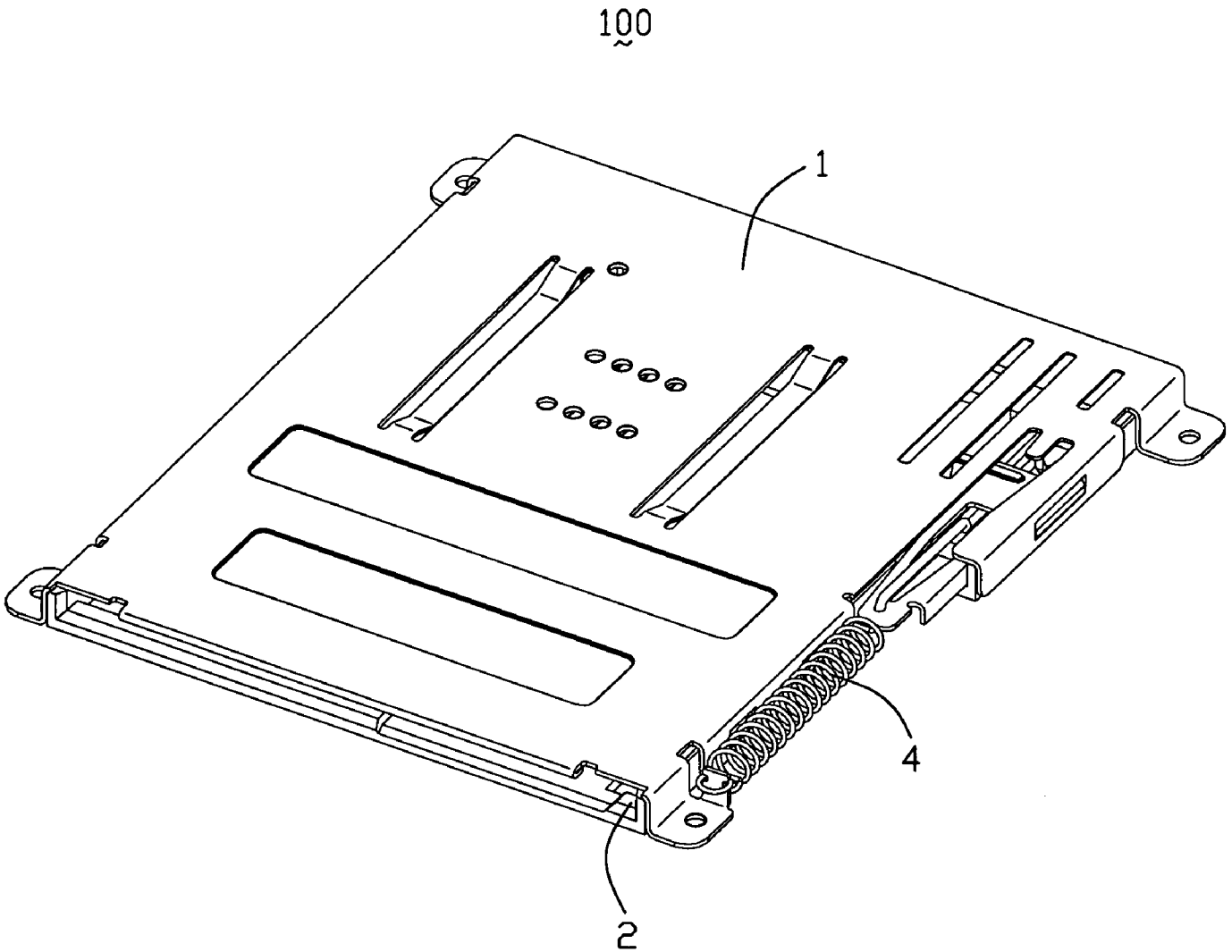
FIG. 1 is a perspective, assembled view of an electrical card connector without an electrical card inserted therein in accordance with the present invention.
Figure 2:
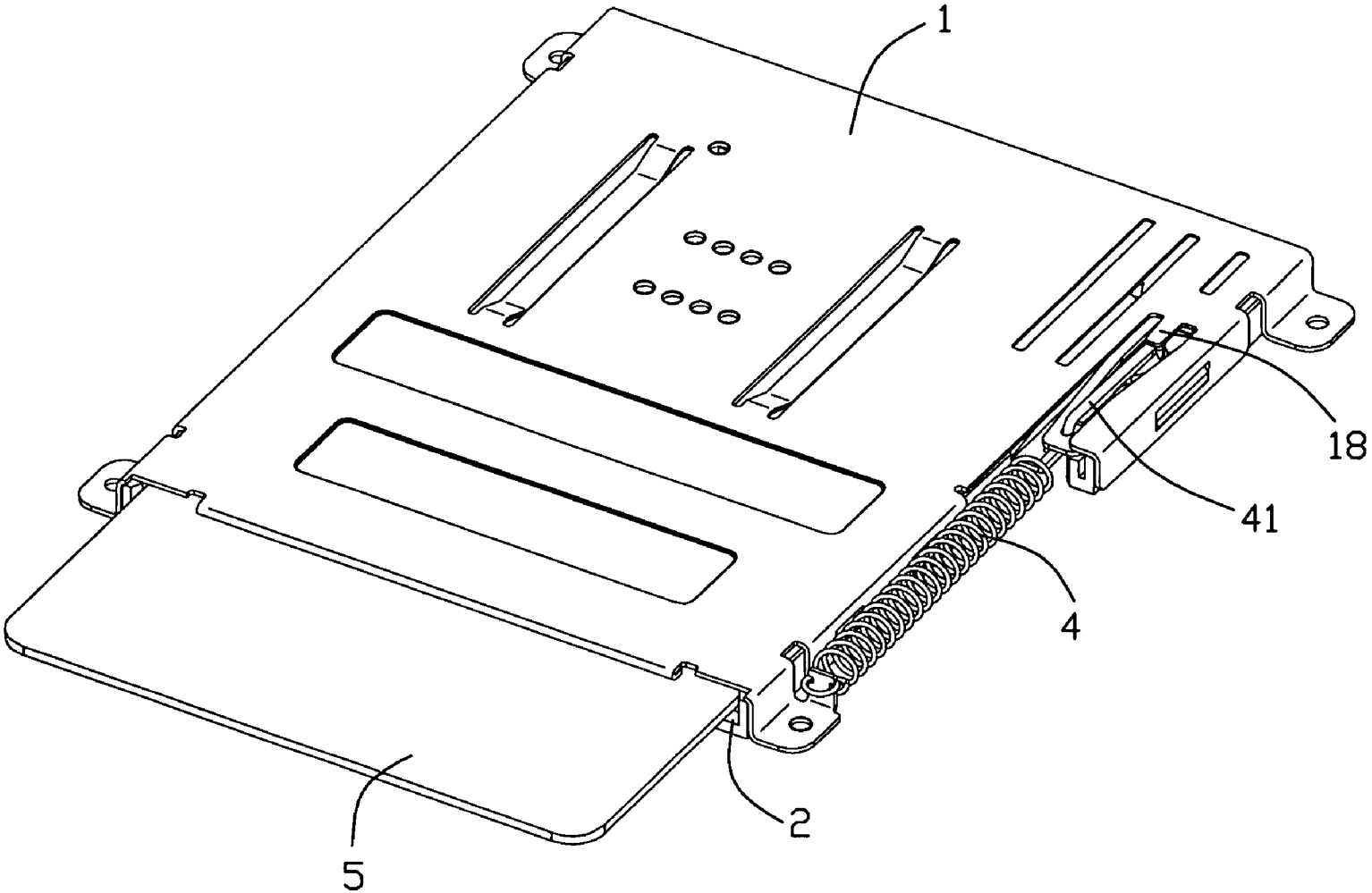
FIG. 2 is a perspective, assembled view of the electrical card connector with an electrical card inserted therein.
Figure 3:
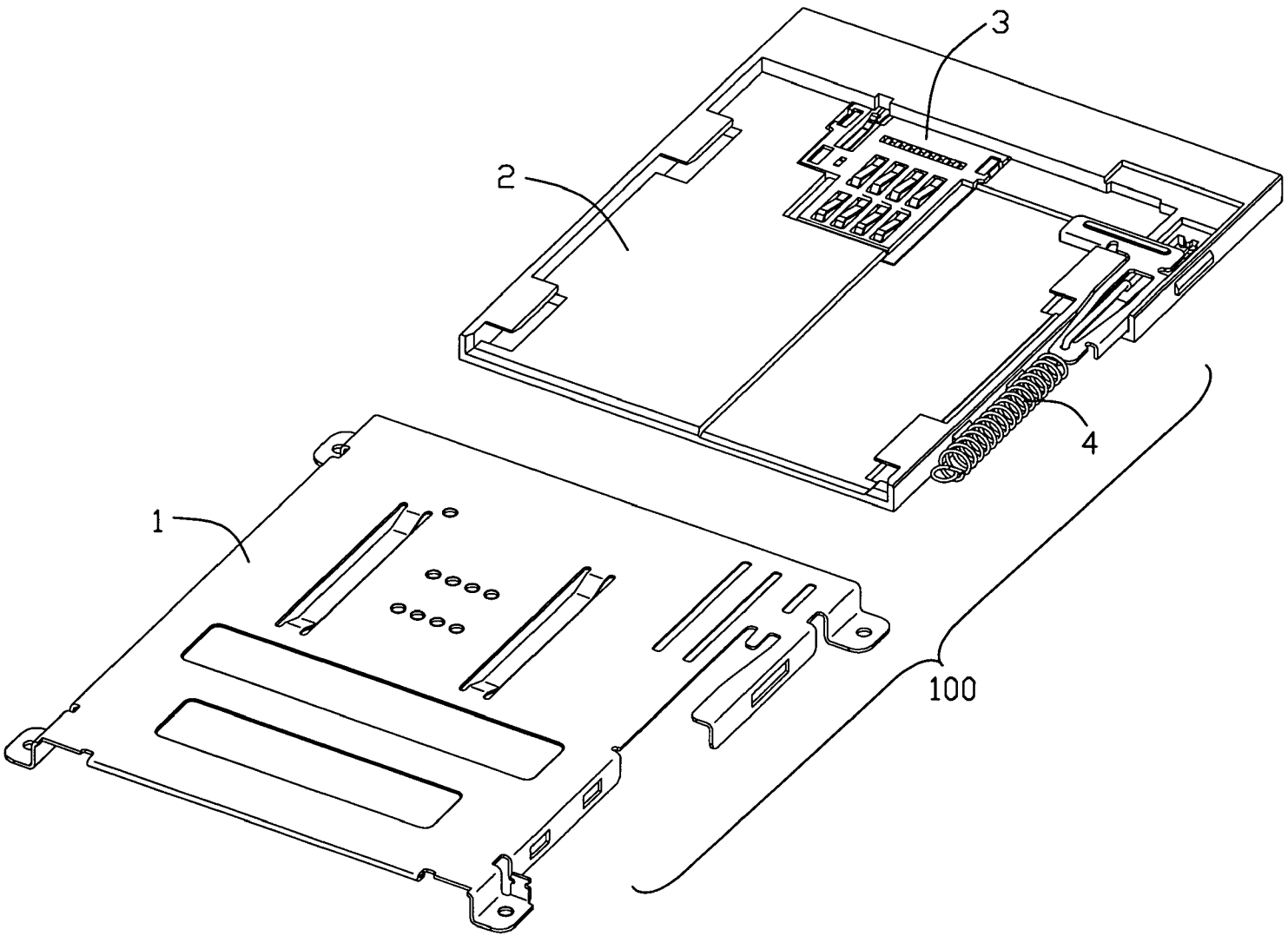
FIG. 3 is a perspective, partly exploded view of the electrical card connector when the electrical card is not inserted.
Figure 4:
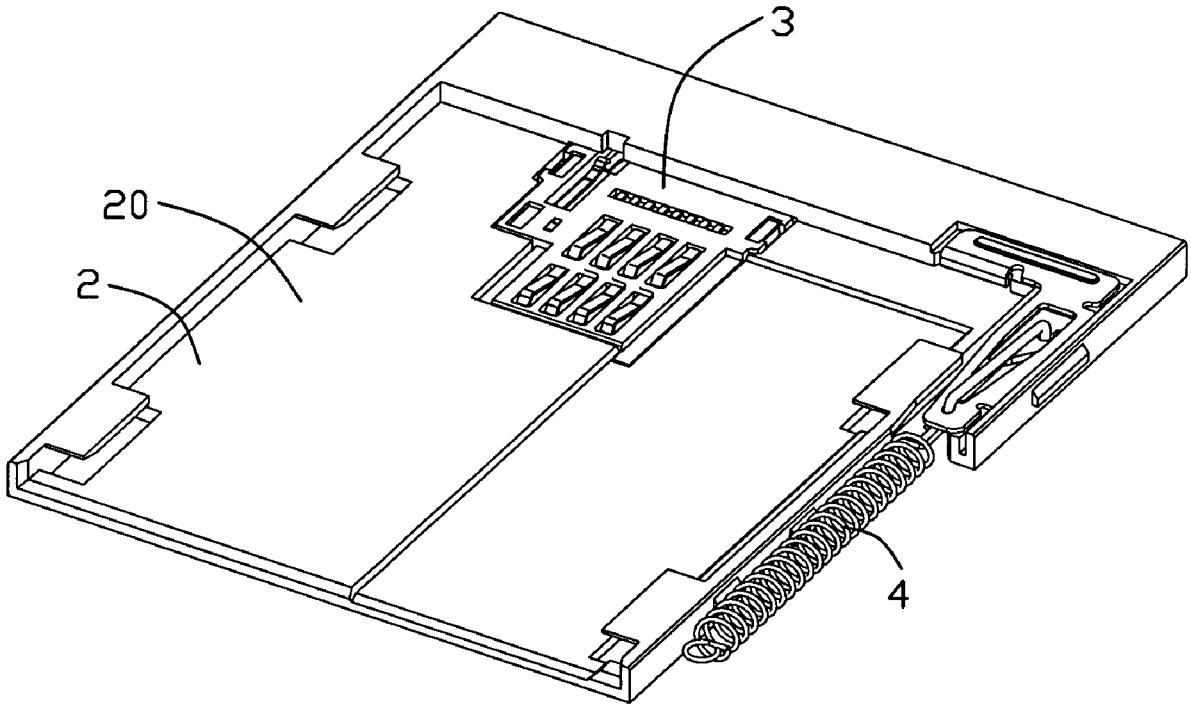
FIG. 4 is a partly assembled view of the electrical card connector when the electrical card is inserted.

Referring to FIGS. 1-8, an electrical card connector 100, assembled on a PCB (not shown), comprises a metal shield 1, an insulating housing 2, a terminal module 3 received in the insulating housing 2 and an ejector 4 assembled on the metal shield 1 and the insulating housing 2. The metal shield 1 associates with the insulating housing 2 to define a receiving room (not labeled) for receiving an electrical card 5, and accordingly, a card insertion/ejection direction is also defined.

Figure 5:
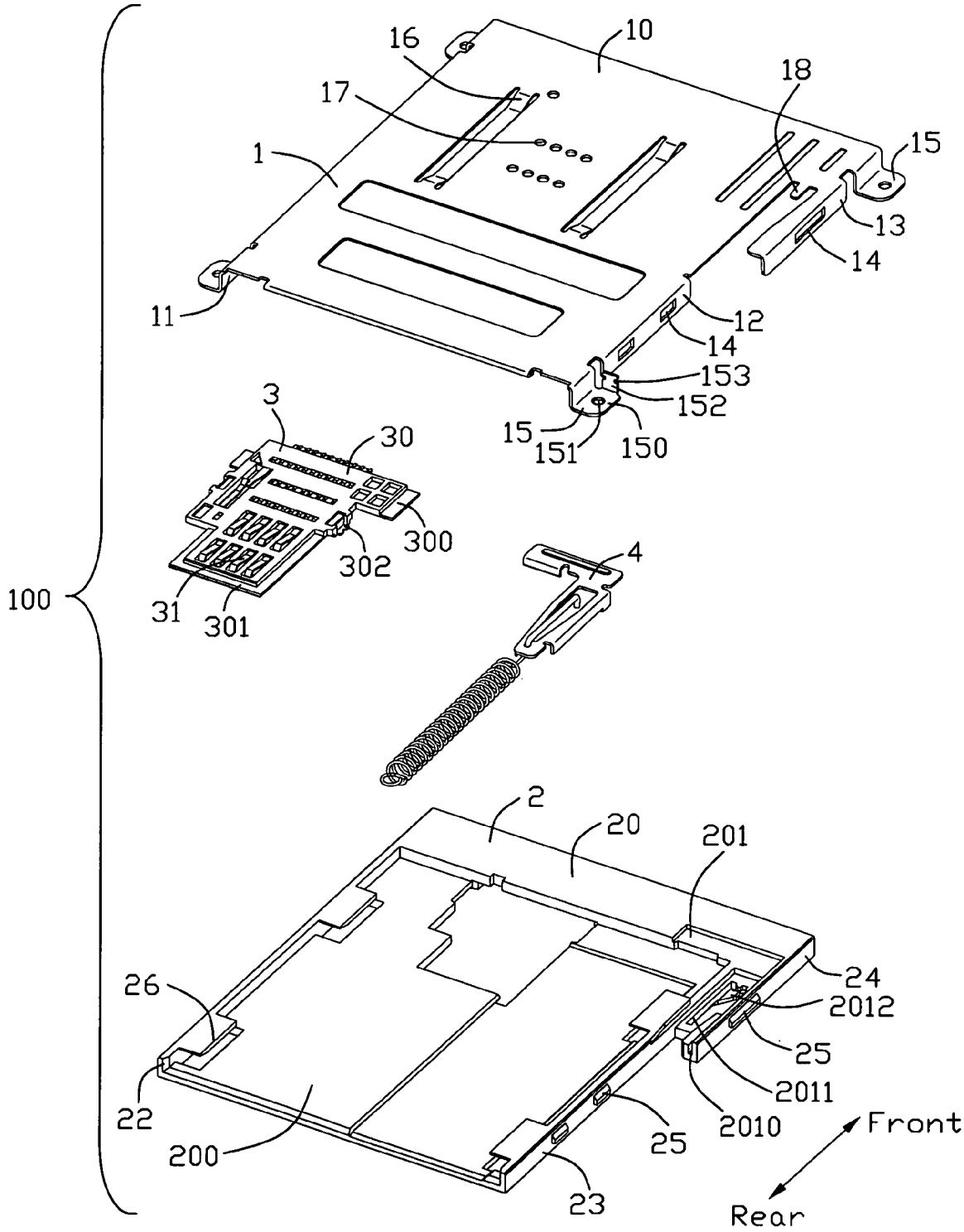
FIG. 5 is a perspective, fully exploded view of the electrical card connector.

Referring to FIG. 5, the metal shield 1 comprises a base 10, a first lateral wall 11, a second lateral wall 12 and a third lateral wall 13. A pair of depressed pieces 16, extending along the card insertion/ejection direction, are formed in the middle of the base 10. A plurality of holes 17 are defined on the base 10 and between the pair of depressed pieces 16. The first lateral wall 11 extends vertically and downwardly from an edge of the base 10. The second lateral wall 12 and the third lateral wall 13 both extend vertically and downwardly from an opposite edge of the base 10 relative to the first lateral wall 11, and further more, a distance between the second lateral wall 12 and the first lateral wall 11 is shorter than that between the third lateral wall 13 and the first lateral wall 11. Each lateral wall 11, 12, 13 defines at least a slot 14 and forms at least a locking board 15 thereon. Each locking board 15 comprises a tongue portion 150 with an orientation hole 151 defined thereon. Additionally, the locking board 15 of the second lateral wall 12 further comprises a fixing piece 152 extending vertically and upwardly from a front end thereof. The fixing piece 152 defines a pair of recesses 153. An opening (not labeled) with a backward exposure, is arranged between the base 10 and the third lateral wall 13, and a resilient piece 18 extends from the base 10 along a front-to-back direction into the opening. According to the miniaturization of smart card connectors, the resilient piece 18 keeps in a plane with the base 10, which means that the resilient piece 18 doesn't bend downwardly. The terms "vertically, upwardly and front" are not meant to be limiting but is descriptive of depiction according to the claims.

Figure 6:
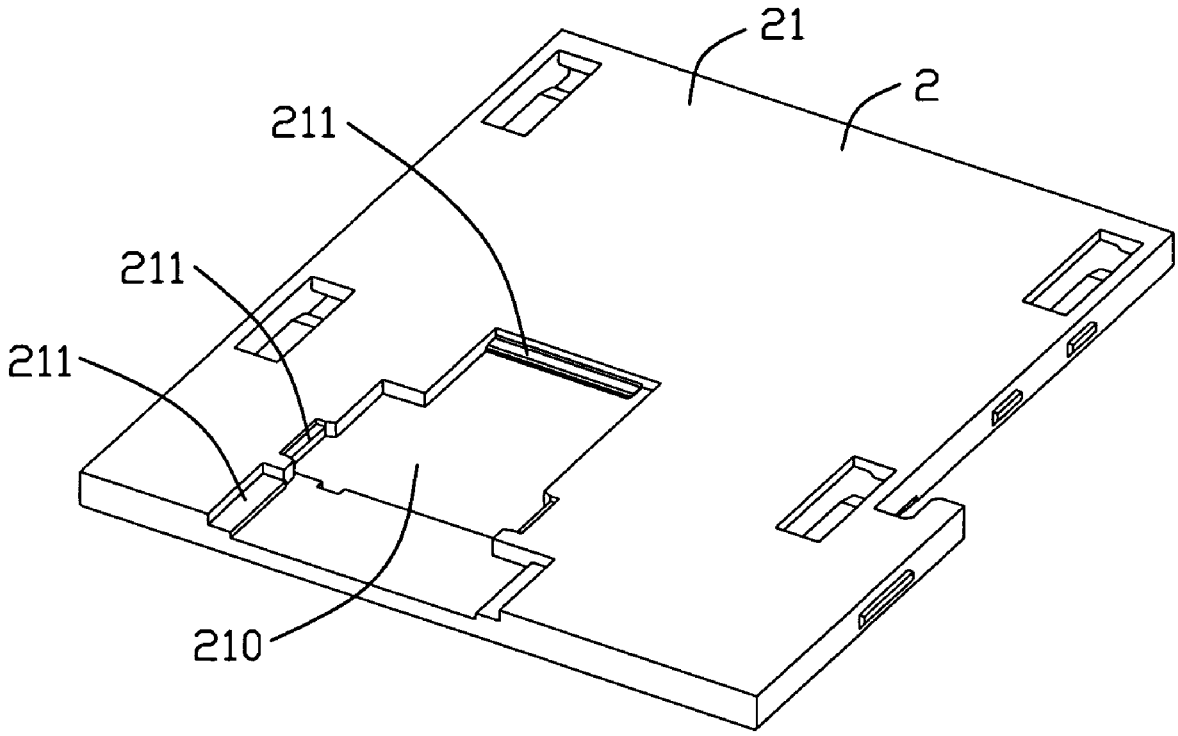
FIG. 6 is a view of an insulating housing of the electrical card connector.

Referring to FIGS. 5-6, the insulating housing 2 comprises a top surface 20, a bottom surface 21, a first lateral side 22, a second lateral side 23 and a third lateral side 24. Each lateral side 22, 23, 24 forms at least a protrusion 25 correspondingly received in the slot 14 of the metal shield 1. The top surface 20 comprises a depressed portion 200 for defining the card receiving room and an L-shaped depressed portion 201 beside the depressed portion 200 for receiving the ejector 4. The depressed portion 200 forms a plurality of limiting boards 26 extending from upper surfaces of the first and second lateral walls 22, 23 for guiding and limiting the inserted electrical card 5. The L-shaped depressed portion 201 comprises a sliding channel 2011, a heart-shaped channel 2012 communicating with the sliding channel 2011 and a guiding channel 2010 located at a side of the guiding channel 2010 and the sliding channel 2011. The heart-shaped channel 2012 comprises a pair of front-to-back extending channels, a pair of inclined channels, respectively connecting with the front-to-back extending channels, communicating with each other and a slant channel connecting the pair of front-to-back extending channels in this embodiment, however, it is not limiting. The bottom surface 21 comprises a receiving portion 210 having a plurality of stepped portions 211.

The terminal module 3 comprises a body portion 30 and a plurality of signal terminals 31 each having a contacting portion (not labeled) and a soldering portion (not labeled). The body portion 30 forms a pair of first extending portions 300 at a front part, a second extending portion 301 at a rear end and a pair of metal ears 302 assembled at opposite sides of a middle part, respectively and correspondingly mating with the stepped portions 211 of the receiving portion 210. Because the shape of the terminal module 3 is approximately the same with the receiving portion 210 of the insulating housing 2, the terminal module 3 is entirely received in the receiving portion 210. The signal terminals 31 are arranged in two row-arrays along the card insertion/ejection direction and the contacting portions extend beyond a top surface of the body portion 30 and into the card receiving room so as to electrically contact with the electrical card 5.

Figure 7:
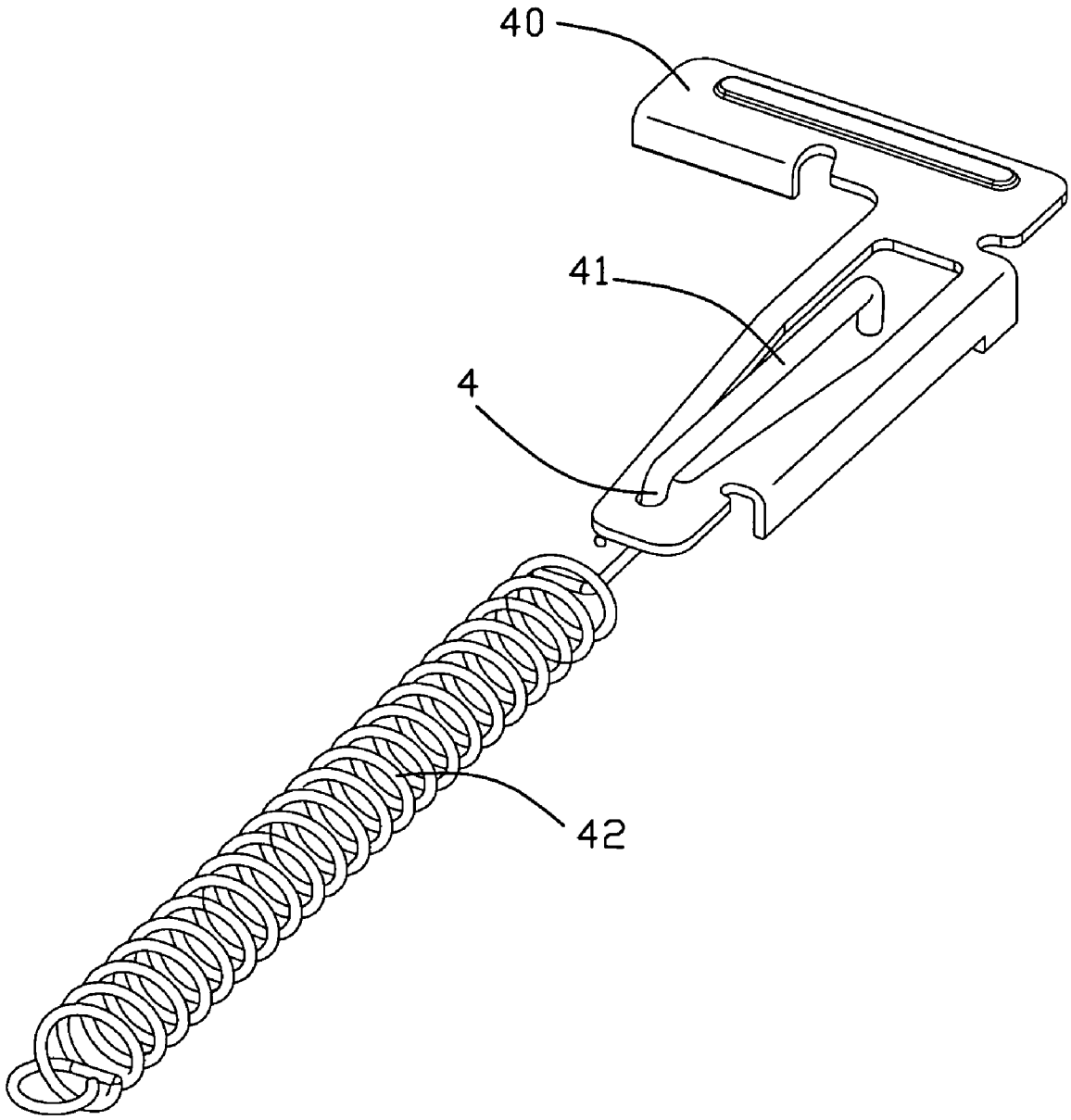
FIG. 7 is a perspective, assembled view of an ejector.
Figure 8:
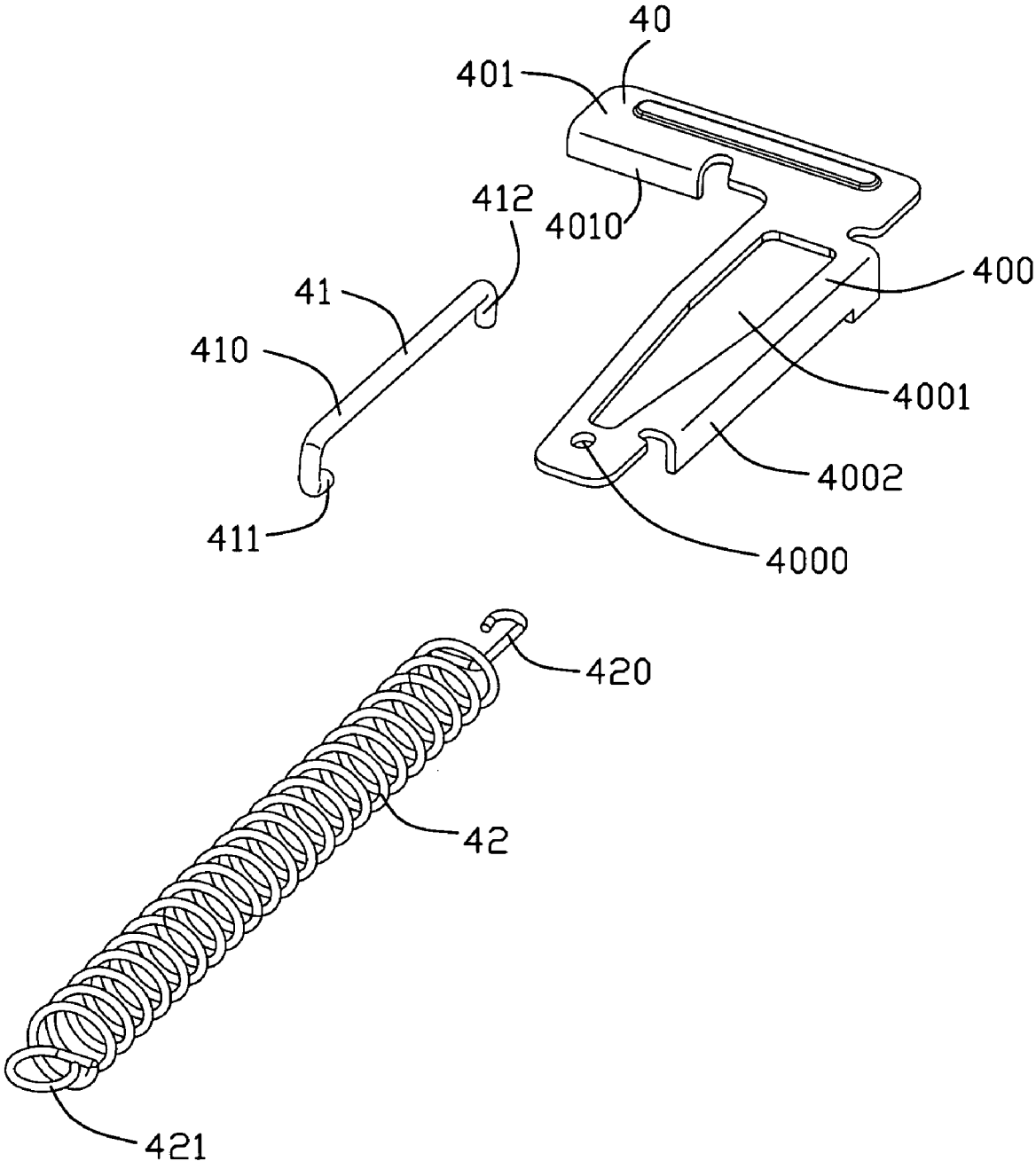
FIG. 8 is a perspective, exploded view of the ejector.

Referring to FIGS. 7-8, the ejector 4 comprises an L-shaped drawer plate 40, a slider pin 41 with two ends 411, 412 bending downwardly and a resilient portion 42 being as a spring in this embodiment. The drawer plate 40 forms a first arm plate 400 extending along the card insertion/ejection direction and a second arm plate 401 extending at a right-angle from a front end of the first arm plate 400 in a horizontal plane. The first arm plate 400 defines a retaining hole 4000 at a rear part thereof for a first end 411 of the slider pin 41 extending through, a limiting hole 4001 at a front part thereof for confining movement of a second end 412 of the slider pin 41 and a guiding wall 4002 extending vertically and downwardly from a right hand side of the first arm plate 400. The guiding wall 4002 is moveably received in the guiding channel 2010 of the insulating housing 2. The second arm plate 401 comprises a confronting surface 4010 extending vertically and downwardly from an inner side thereof so that the electrical card 5, whose front edge confronts with the confronting surface 4010, can be drawn out of the card receiving room by the drawer plate 40 when a second thrust is pressed on the electrical card 5 (a first thrust pushes the electrical card 5 into the card receiving room). The first end 411 of the slider pin 41 has a free end thereof extending towards the second end 412 of the slider pin 41. The first end 411 of the slider pin 41 goes through the retaining hole 4000 and locks with the resilient portion 42. The second end 412 of the slider pin 41 is limited by the limiting hole 4001 and moveably received in the heart-shaped channel 2012. The resilient portion 42 forms a hook at each end. The first hook 420 locks with the first end 411 of the slider pin 41 and the second hook 402 locks with the recesses 153 of the fixing piece 152 of the metal shield 1 for not breaking off the metal shield 1.

The second end 412 of the slider pin 41 of the ejector 4 moves in the heart-shaped channel 2012 during the push-and-pull of the electrical card 5. When the second end 412 of the slider pin 41 is positioned at the jointing point of the inclined channels of the heart-shaped channel 2012, the electrical card 5 is completely received in the electrical card connector 100. As this moment, the slider pin 41 reposes and is easy to rise up to disengage from the heart-shaped channel 2012 cause of the resumable resilient portion 42. The resilient piece 18, which extends from the base 10 of the metal shield 1 along the front-to-back direction, presses against the second end 412 of the slider pin 41 to prevent the second end 412 from disengaging from the heart-shaped channel 2012. For the shorter length of the resilient piece 18, the resilient piece 18 has a larger stress so that it prevents the second end 412 from rising up and disengaging away from the heart-shaped channel 2012 more effectively.

In fact, whether the resilient piece 18 extends along the front-to-back direction is not absolute, if we change over a location of the three parts of the ejector 4, in which, the retaining hole 4000 is arranged at a front part of the limiting hole 4001 on the first arm plate 400, and the first end 411 of the slider pin 41 locked with the retaining hole 4000 is located at a front part of the second end 412 limited in the limiting hole 4001, accordingly, the resilient piece 18 correspondingly extending towards a back-to-front direction can also achieve the above object.

While a preferred embodiment in accordance with the present invention has been shown and described, equivalent modifications and changes known to persons skilled in the art according to the spirit of the present invention are considered within the scope of the present invention as described in the appended claims.

I claim:

1. An electrical card connector, comprising:

an insulating housing having a heart-shaped channel recessed thereon, the heart-shaped channel comprising a pair of front-to-back extending channels and a pair of inclined channels, respectively connecting with the front-to-back extending channels, communicating with each other;

a module having a plurality of terminals received in a receiving portion of the insulating housing;

a metal shield associated with the insulating housing and commonly defining a card receiving room; and an ejector comprising a slider pin movably received in the heart-shaped channel; wherein the metal shield comprises a resilient piece extending to the upside of the jointing point of the inclined channels of the heart-shaped channel wherein the metal shield comprises a base, a first lateral wall located at one side of the base, a second lateral wall and a third lateral wall both located at an opposite side of the base, and a distance between the first and second lateral walls is shorter than that between the first and third lateral walls;

wherein an opening is arranged between the base and the third lateral wall and the resilient piece is located in the opening;

wherein each lateral wall forms a locking board and the locking board of the second lateral wall comprises a fixing piece extending vertically and upwardly; and wherein the ejector further comprises a drawer plate and a resilient portion, and the slider pin of the ejector having a first end connected the drawer plate and the resilient portion together.

2. The electrical card connector as described in claim 1, wherein the drawer plate defines a retaining hole and a limiting hole along a card insertion/ejection direction and the slider pin forms the first end extending through the retaining hole and a second end, confined to the limiting hole and movably received in the heart-shaped channel.

3. The electrical card connector as described in claim 2, wherein the resilient portion forms a hook at each end thereof and one hook engages with the first end of the slider pin.

4. The electrical card connector as described in claim 3, wherein the other hook of the resilient portion engages with the fixing piece of the metal shield.

5. The electrical card connector as described in claim 1, wherein the insulating housing comprises a depressed portion forming the card receiving room and an L-shaped depressed portion located beside the depressed portion and receiving the drawer plate, and the heart-shaped channel is recessed on the L-shaped depressed portion.

6. The electrical card connector as described in claim 5, wherein a plurality of limiting boards are located above the depressed portion.

7. The electrical card connector as described in claim 5, wherein the L-shaped depressed portion comprises a sliding channel communicating with the heart-shaped channel and a guiding channel arranged at a side of the sliding channel and the heart-shaped channel.

8. The electrical card connector as described in claim 7, wherein the drawer plate comprises a guiding wall received in the guiding channel of the insulating housing.

9. The electrical card connector as described in claim 1, wherein the terminals are arranged in two-row arrays on a terminal module which is received in the insulating housing.

10. The electrical card connector as described in claim 9, wherein each terminal has a contacting portion and a soldering portion, and the contacting portions, extend beyond a top surface of the terminal module and into the card receiving room.

* * * * *